US010639711B2

(12) United States Patent
Liu

(10) Patent No.: US 10,639,711 B2
(45) Date of Patent: May 5, 2020

(54) NANOWIRE-BASED MAGNETS AND METHODS OF MAKING SAME

(71) Applicant: Board of Regents, The University of Texas System, Austin, TX (US)

(72) Inventor: J. Ping Liu, Colleyville, TX (US)

(73) Assignee: Board of Regents, The University of Texas System, Austin, TX (US)

( * ) Notice: Subject to any disclaimer, the term of this patent is extended or adjusted under 35 U.S.C. 154(b) by 389 days.

(21) Appl. No.: 15/180,939

(22) Filed: Jun. 13, 2016

(65) Prior Publication Data

US 2017/0066049 A1 Mar. 9, 2017

Related U.S. Application Data

(60) Provisional application No. 62/175,259, filed on Jun. 13, 2015.

(51) Int. Cl.

| | |
|---|---|
| ***B22F 1/00*** | (2006.01) |
| ***B22F 9/24*** | (2006.01) |
| ***C22C 38/10*** | (2006.01) |
| ***C22C 19/07*** | (2006.01) |
| ***H01F 1/047*** | (2006.01) |

(52) U.S. Cl.

CPC ..... *B22F 1/0025* (2013.01); *B22F 9/24* (2013.01); *C22C 19/07* (2013.01); *C22C 38/10* (2013.01); *H01F 1/047* (2013.01); *B22F 2009/245* (2013.01); *B22F 2301/15* (2013.01); *B22F 2301/35* (2013.01); *B22F 2998/10* (2013.01)

(58) Field of Classification Search

CPC ..... B22F 1/0025; B22F 9/24; B22F 2301/15; B22F 2301/35; C22C 19/07; C22C 19/03; H01F 1/047; H01F 1/14; H01F 1/14708

See application file for complete search history.

(56) References Cited

FOREIGN PATENT DOCUMENTS

WO WO 2012/111837 * 8/2012

OTHER PUBLICATIONS

Maurer et al, "Magnetic nanowires as permanent magnetic materials", Applied Phys. Letters, 91, 172501, pp. 172501-1 to 172501-3 , Oct. 22, 2007.*

Soulantica et al, "Magnetism of sigle-crystalline Co nanorods", Applied Phys. letters, 95, 152504, pp. 152504-1 to 152504-3, Oct. 13, 2009.*

Lin et al, "Shape Effects of Iron Nanowires on Hyperthermia Tratment", Journal of Nanomaterials, vol. 2013, Article ID 237439, pp. 1-6, 2013, no month.*

Gandha et al, "Effect of RuCl3 on Morphology and Magntic Propeties of CoNi Nanowires", IEEE Transactions on Magnetics, vol. 49, No. 7, pp. 3273-3276, Jul. 2013.*

Gandha et al, "High Energy Product Developed from Cobalt Nanowire", Sciemtific reports, 4:5354, pp. 1-5, Jun. 18, 2014.*

Ganda et al, "Synthesis and Characterization of FeCo nanowires with high coercivity", Nanotechnology, 26, pp. 1-6, Jan. 22, 2015.*

Alagiri et al., "Synthesis of Iron Nanowires and its Magnetic propeties", International Journal of ChemTeach Research, vol. 7, No. 3, ICONN 2015, Feb. 4-6, 2015, pp. 1612-1615.*

Ait-Atmane, et al. "High temperature structural and magnetic properties of cobalt nanorods" J. Solid State Chem. 197, 297-303 (2013).

Alikhanzadeh-Arani, et al. "Magnetic characterization of FeCo nanowire arrays by first-order reversal curves" J. Curr. Appl. Phys. 13, 664-669 (2013) available online Nov. 23, 2012.

Atmane, et al. "High temperature structural and magnetic properties of cobalt nanorods" J. Solid State Chem. 197, 297-303 (2013).

Azizi, et al. "Morphology and magnetic properties of FeCo nanocrystalline powder produced by modified mechanochemical procedure" J. Magn. Magn. Mater. 322 3551 (2010).

Bao, et al. "The Critical Role of Surfactants in the Growth of Cobalt Nanoparticles" Langmuir 26, 478-483 (2010) published on web Sep. 10, 2009.

Burkert, et al. "Giant Magnetic Anisotropy in Tetragonal FeCo Alloys" Phys. Rev. Lett. 93, 027203 (week ending Jul. 9, 2004).

Buschow, K. H. J. "Intermetallic compounds of rare-earth and 3d transition metals. Reports on Progress in Physics" Rep. Prog. Phys. 40, 1179-1256 (1977).

Cao, et al. "Template-free synthesis and characterization of leaf-like Fe—Ni microstructures" Adv. Mater. Lett. 4(2), 160-163 (2013).

Cattaneo, et al. "Electrodeposition of hexagonal Co nanowires with large magnetocrystalline anisotropy" Electrochim. Acta 85, 57-65 (2012).

Chaubey, et al. "Synthesis and Stabilization of FeCo Nanoparticles" J. Am. Chem. Soc. 129 7214 (published on web May 12, 2007.

Cowburn, et al. "Room Temperature Magnetic Quantum Cellulare Automata" Science 287, 1466-1468 (Feb. 25, 2000).

Cullity, et al. "Introduction to Magnetic Materials 2nd edition" (John Wiley & Sons, Inc., 2009).

Dumestre, et al. "Shape Control of Thermodynamically Stable Cobalt Nanorods through Organometallic Chemistry" Angew. Chem. Int. Ed. 41, 4286-9 (2002).

(Continued)

*Primary Examiner* — C Melissa Koslow

(74) *Attorney, Agent, or Firm* — Christopher S. Dodson; Nexsen Pruet, PLLC

(57) ABSTRACT

The present invention achieves a high-energy product using Ferromagnetic 3D elements such as nanowires and methods of making the same. The high energy products or magnets of the invention are able to achieve high magnetization and maintain the magnetic properties at a greater range of temperatures than currently known magnets. For example, a high energy product includes at least one material A selected from the group consisting essentially of Fe, Co, and Ni, wherein material A is in the form of nanowires formed by a solvothermal chemical process. A high energy product may also include at least one material A selected from the group consisting essentially of Fe, Co, and Ni, and at least one material B selected from the group consisting essentially of Fe, Co, and Ni, wherein material A and material B are in the form of an alloy of nanowires formed by a solvothermal chemical process.

15 Claims, 8 Drawing Sheets

(56) References Cited

OTHER PUBLICATIONS

Elias, et al. "Production and Characterization of Single-Crystal FeCo Nanowires Inside Carbon Nanotubes" Nano Letters 2005, vol. 5, No. 3, 467-472.
Fang, et al. "Optimization of the magnetic properties of aligned Co nanowires/polymer composites for the fabrication of permanent magnets" J. Nanopart. Res. 16, 2265 (published online Jan. 21, 2014).
Fodor, et al. "Fabrication and characterization of Co1AxFex alloy nanowires" J. Appl. Phys. 91 8186 (May 15, 2002).
Gandha, et al. "Effect of RuCl3 on Morphology and Magnetic Properties of CoNi Nanowires" IEEE Trans. Magn. 49, 3273-3276 (Jul. 2013).
Gandha, et al. "High Energy Product Developed from Cobalt Nanowires" Sci. Rep. 4:5345 (published Jun. 18, 2014).
Gandha, et al. "Synthesis and characterization of FeCo nanowires with high coercivity" Nanotechnology 26 (published Jan. 22, 2015) 075601.
Gutfleisch, et al. "Magnetic materials and devices for the 21st century: stronger, lighter, and more energy efficient" Adv. Mater. 23, 821-842 (2011).
Hao, et al. "Synthesis, Functionalization, and Biomedical Applications of Multifunctional Magnetic Nanoparticles" Adv. Mater. 22, 2729-2742 (2010).
Kulkarni, et al. "Polymer support with Schiff base functional group with cobaltous palmitate as oxidation catalyst for cyclohexane" Appl. Catal. A 142, 243-254 (1996).
LaMer, et al. "Theory, Production and Mechanism of Formation of Monodispersed Hydrosols" J. Am. Chem. Soc. 72 4847 (Nov. 17, 1950).
Lee, et al. "Arrays of ferromagnetic FeCo and FeCr binary nanocluster wires" J. Appl. Phys. 94 4179 (Sep. 15, 2003).
Li, Lin "High temperature magnetic properties of 49%Co-2%V—Fe alloy" J. Appl. Phys. 79, 4578-4580 (Apr. 15, 1996).
Lin, et al. "Shape of Iron Nanowires on Hyperthermia Treatment" J. Nanomater. 237439 (2013).
Luo, et al. "Enhanced magnetic performance of metalorganic nanowire arrays by FeCo/polypyrrole coelectrodeposition" Appl. Phys. 113, 17B908 (Apr. 2013).
Maurer, et al. "Magnetic nanowires as permanent magnet materials" Appl. Phys. Lett. 91, 172501 (2007).
McHenry, et al. "Amorphous and Nanocrystalline Materials for Applications as Soft Magnets" Prog. Mater. Sci. 44, 291-433 (1999).
Morales, et al. Surface and Internal Spin Canting in γ-Fe2O3 Nanoparticles Chem. Mater. 11 3058 (published on web Oct. 27, 1999).
Nair, et al. "Evolutionary shape control during colloidal quantum-dot growth" Small 3 481-487 (2007). Small 3 481 (2007).
Panagiotopoulos, et al. "Packing fraction dependence of the coercivity and the energy product in nanowire based permanent magnets" J. Appl. Phys. 114, 143902 (2013).
Poudyal, et al. "Synthesis of FePt nanorods and nanowires by a facile method" Nanotechnology 19, 355601 (published Jul. 18, 2008).
Privman, et al. "Mechanism of Formation of Monodispersed Colloids by Aggregation of Nanosize Precursors" Colloid Interface Sci. 213 36 (1999).
Puntes, et al. "Colloidal Nanocrystal Shape and Size Control: The Case of Cobalt" Science 291 2115 (Mar. 16, 2001).
Qin, et al. "A study of magnetic properties: FexCo1-x alloy nanowire arrays" Chem. Phys. Lett. 374, 661-666 (2003).
Sellmyer, et al. "Magnetism of Fe, Co and Ni nanowires in self-assembled arrays" J. Phys. Condens. Matter 13, R433-R460 (2001).
Skomski, et al. "Permanent magnetism of dense-packed nanostrucutres" J. Appl. Phys. 107, 09A739 (published online May 4, 2010).
Soulantica, et al. "Magnetism of single-crystalline Co nanorods", Appl. Phys. Lett. 95, 152504 (published online Oct. 13, 2009).
Soumare, et al. Kinetically Controlled Synthesis of Hexagonally Close-Packed Cobalt Nanorods with High Magnetic Coercivity, Adv. Funct. Mater. 19, 1971-1977 (2009).
Soumare, et al. "Nickel nanofibers and nanowires: Elaboration by reduction in polyol medium assisted by external magnetic field" Solid State Commun. 151, 284-288 (2011) available online Dec. 10, 2010.
Stoner, et al. "A mechanism of magnetic hysteresis in heterogeneous alloys" Philos. Trans. R. Soc. London A240, 599-642 (May 4, 1948).
Su, et al. "Geometry dependence of the annealing effect on the magnetic properties of Fe48Co52 nanowire arrays" Nanotechnology 16, 429-432 (published Feb. 7, 2005).
Sudfeld, et al. Microstructural investigation of ternary alloyed magnetic nanoparticles, J. Magn. Magn. Mater. 293, 151-161 (2005).
Sun, et al. "Tuning the properties of magnetic nanowires" IBM J. Res. & Dev. 49, 79-102 (Jan. 2005).
Tang, et al. "Nanostructure and magnetic properties of Fe69Co31 nanowire arrays" Chem. Phys. Lett. 384 1-4 (2004).
Thongmee, et al. "Fabrication and magnetic properties of metallic nanowires via AAO templates" J. Magn. Magn. Mater. 321, 2712-2716 (available online Apr. 1, 2009).
Warner, et al. Shape control of PbS nanocrystals using multiple surfactants Nanotechnology 19 305605 (published Jun. 16, 2008).
Wen, et al. "Length-Controllable Catalyzing-Synthesis and Length-Corresponding Properties of FeCo/Pt Nanorods" Inorg. Chem. 50 9393 (published Sep. 8, 2011).
Xia, et al. "Shape-Controlled Synthesis of Metal Nanocrystals: SimpleChemistry Meets Complex Physics?" Chem., Int. Ed. Engl. 48 60 (available in PMC Dec. 11, 2009).
Xu, et al. "High-magnetic-moment multifunctional nanoparticles for nanomedicine applications" J. Magn. Magn. Mater. 311, 131-134 (2007) available online Dec. 8, 2006.
Yue, et al. "Characterization and magnetic properties of Fe70Co30 alloy nanowire arrays" J. Appl. Phys. 105 074312 (2009).
Zhang, et al. "Controlled synthesis and magnetic properties of hard magnetic CoxC (x = 2, 3) nanocrystals" J. Magn. Magn. Mater. 323, 1495-1500 (available online Jan. 12, 2011).
Menon, L. et al. "Magnetic and Structural Properties of Electrochemically Self-Assembled Fe1-xCox Nanowires." J. Nanosei. Nanotech. 2001, 2, 149-152.

* cited by examiner

FIG. 3A
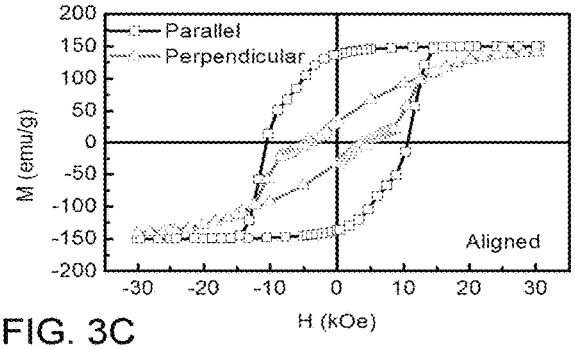
FIG. 3B
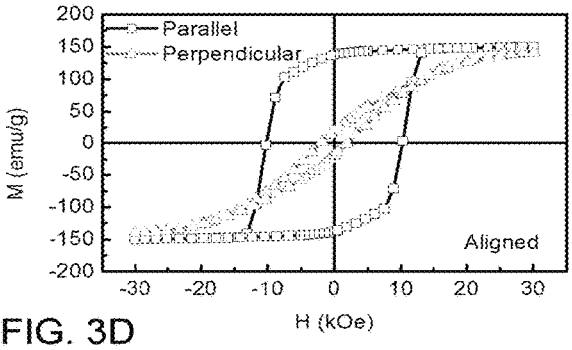
FIG. 3C
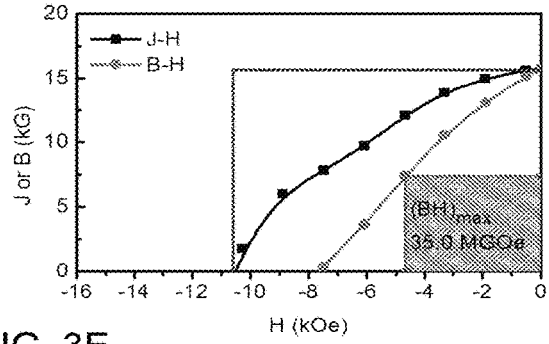
FIG. 3D
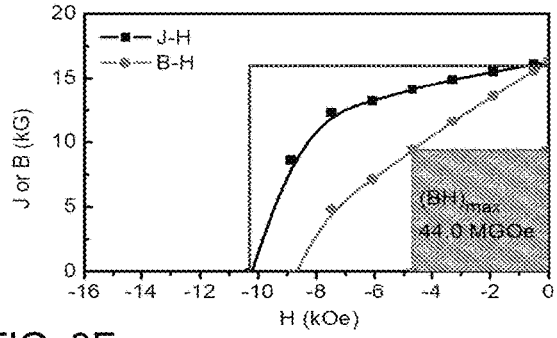
FIG. 3E
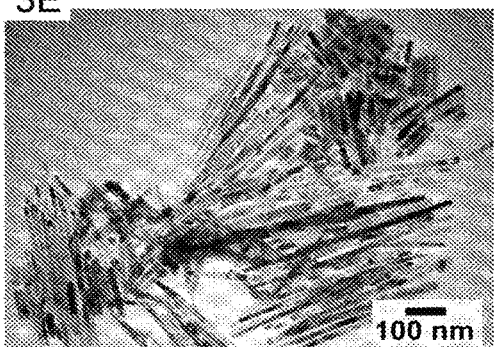
FIG. 3F
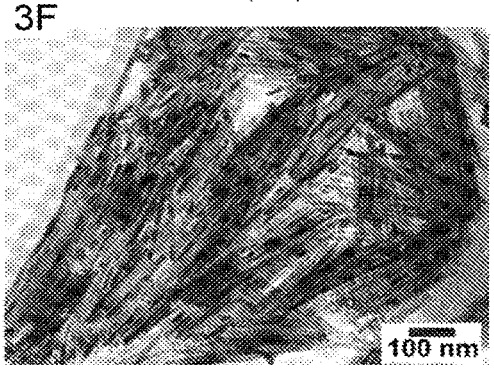
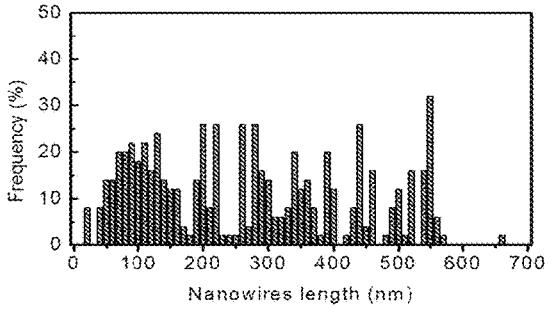
FIG. 3G
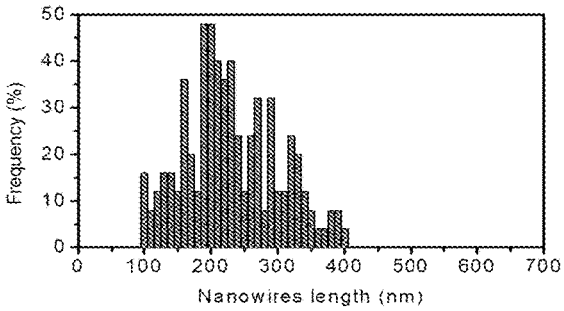
FIG. 3H FIG. 4A
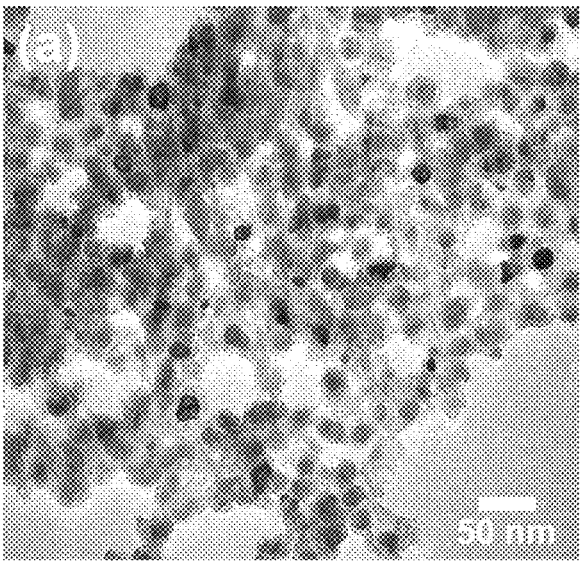
FIG. 4B
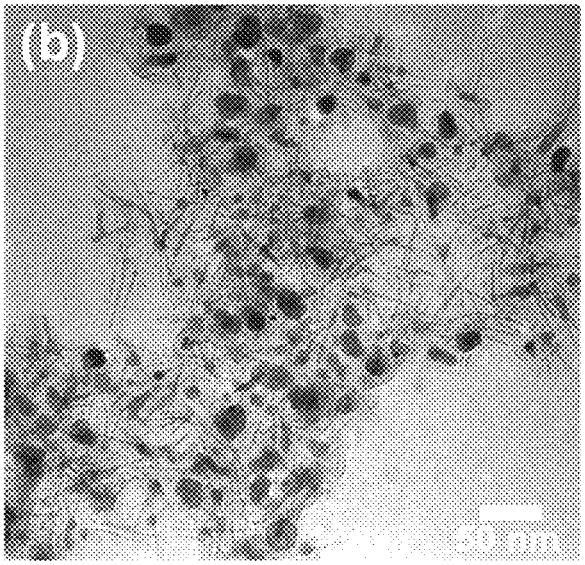
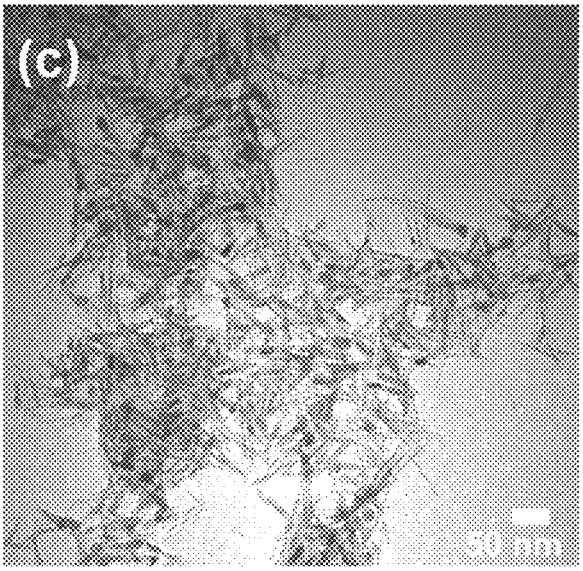
FIG. 4C
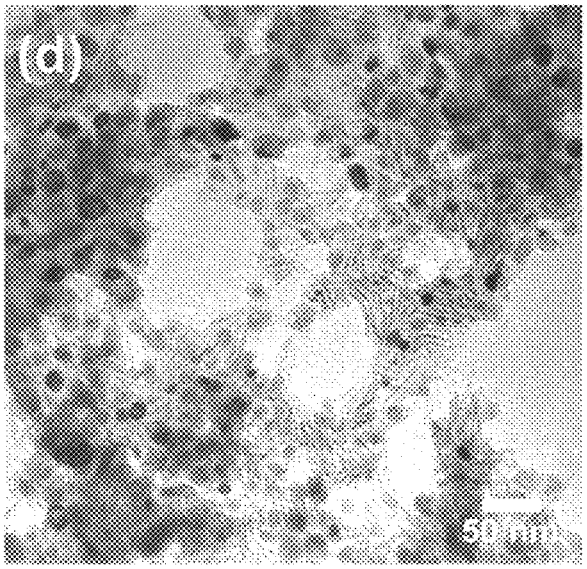
FIG. 4D FIG. 5A
FIG. 5B
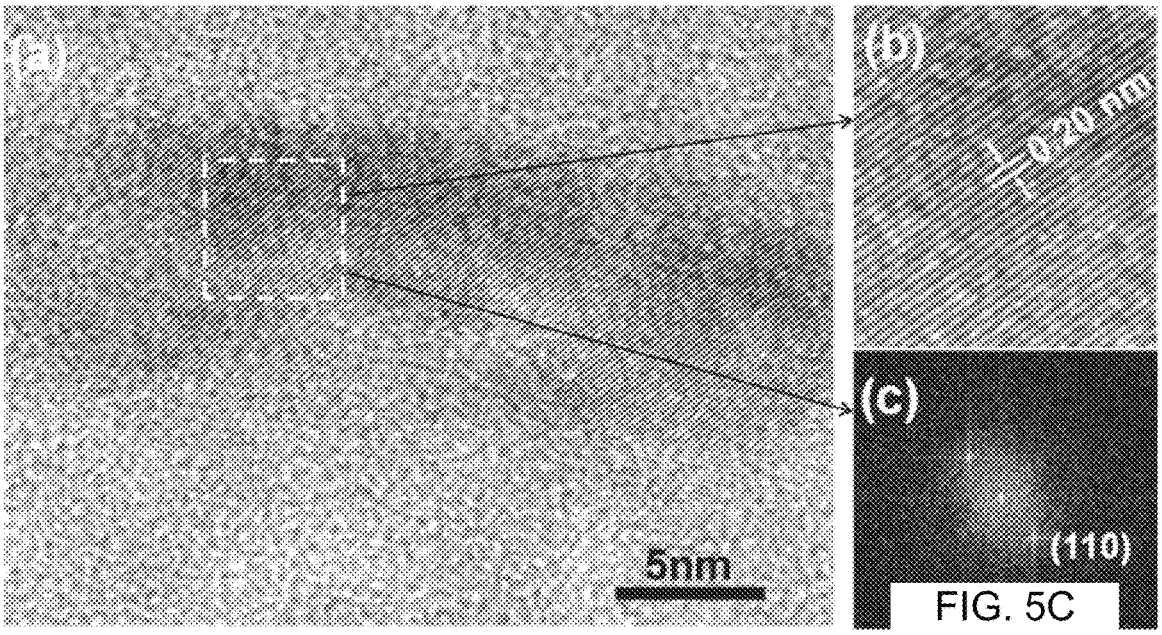
FIG. 5C
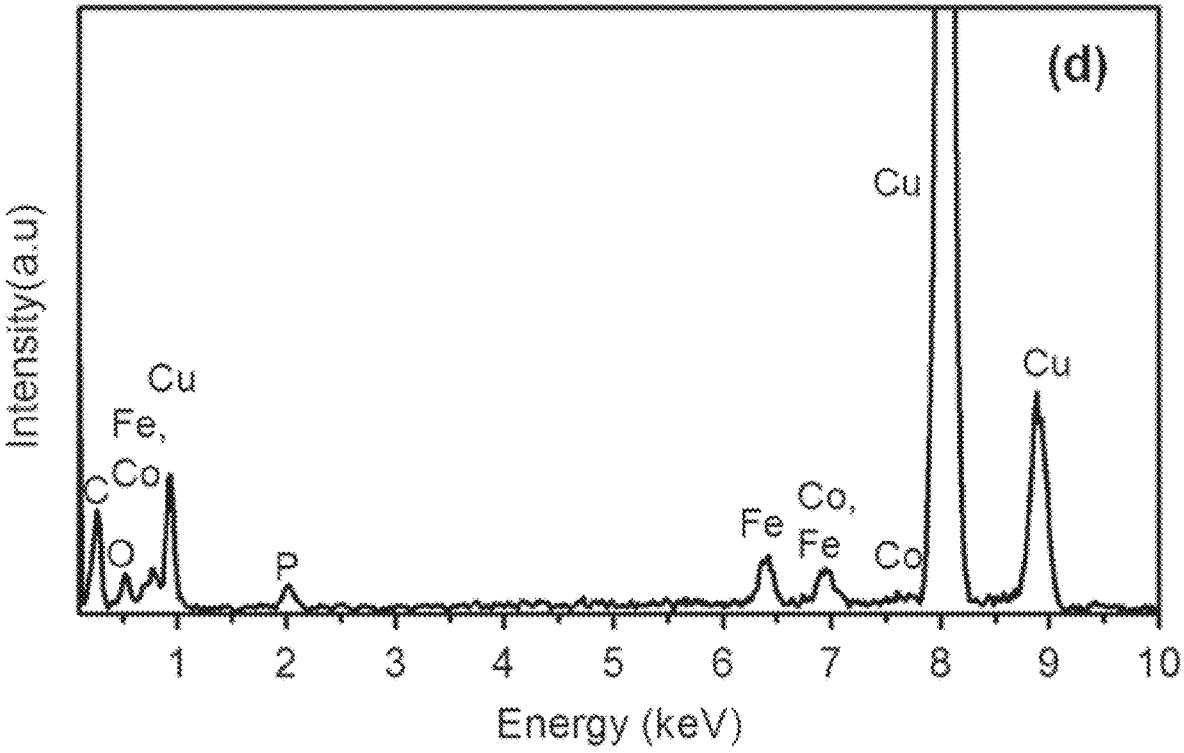
FIG. 5D FIG. 6A
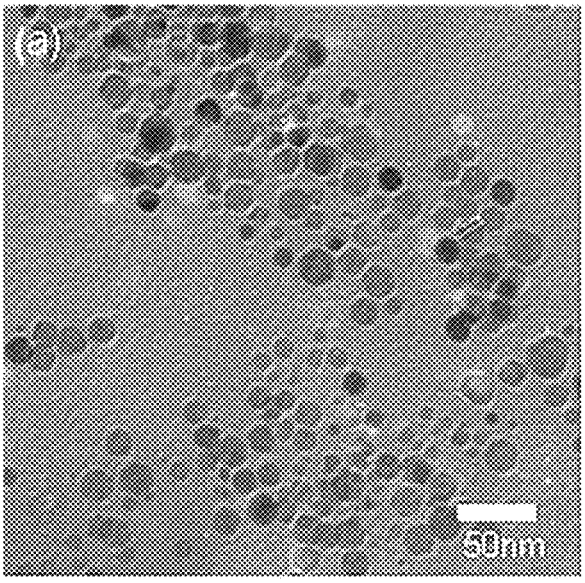
FIG. 6B
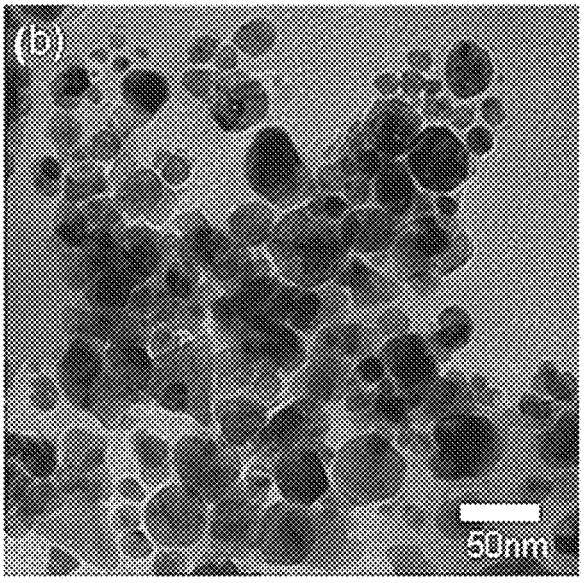
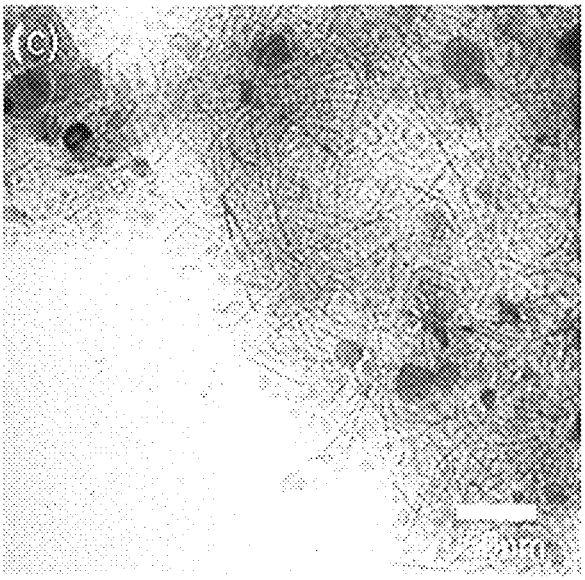
FIG. 6C
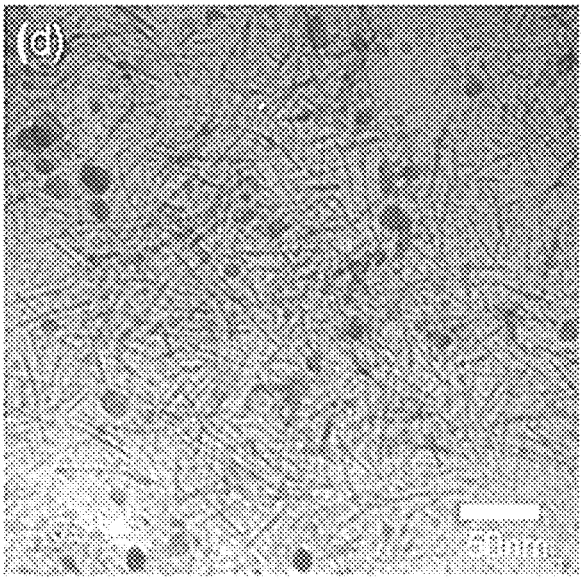
FIG. 6D

NANOWIRE-BASED MAGNETS AND METHODS OF MAKING SAME

STATEMENT OF FEDERALLY FUNDED RESEARCH

This invention is based in part upon work supported by the US DoD/ARO under grant No: W911NF-11-1-0507. The government has certain rights in this invention.

PRIORITY CLAIM AND CROSS-REFERENCE TO RELATED APPLICATIONS

This application claims priority to and is a nonprovisional of U.S. provisional patent application Ser. No. 62,175,259 filed on Jun. 13, 2015, which is hereby incorporated by reference in its entirety.

FIELD OF THE INVENTION

The present invention relates generally to the field permanent magnets using materials that are an alternative to rare earth materials.

BACKGROUND OF THE INVENTION

Permanent magnets are traditionally made using rare earth materials (REMs) to achieve a high magnetization. With the dwindling resources, REMs are becoming more complex and expensive to source, thereby making permanent magnets more expensive. The dwindling resources of REMs are unable to match the demand for more permanent magnets, which have become homogenous in the design and function of modern electrical and electronic devices. This trend has given rise to extensive research in the use of ferromagnetic materials as an alternative to REMs. Ferromagnetic materials natively have a few advantages over REMs such as relatively higher magnetization and better thermal stability. Ferromagnetic materials, although cheaper and more abundant than REMs, have failed to act as an adequate replacement because of their high saturation magnetization, high Curie temperatures and low coercivity. The low coercivity is derived from their low magneto-crystalline anisotropy.

Making use of shape anisotropy of ferromagnets to develop coercivity has been explored previously. The best example of the same may be the Al—Ni—Co alloy (Alnico) permanent magnets that have been produced since the 1930s. In an Alnico magnet, the microstructure is primarily composed of two nano-scale phases formed through spinodal decomposition: isolated needles of ferromagnetic FeCo-rich phase and a non-magnetic matrix of NiAl-rich phase. However, performance of Alnico magnets is still restricted by their very modest coercivity (typical magnetic properties of commercial Alnico magnets have their coercivity Hci<1.5 kOe and energy product $(BH)_m$<10 MGOe).

Extensive research in recent years in magnetic nanoparticles, especially in magnetic nanowires and nanorods, has renewed the interests in developing high coercivity in transition metal nanocrystals based on shape anisotropy. Electrochemical deposition and chemical synthesis are widely adopted to produce Co and Fe based ferromagnetic nanowires and nanorods with enhanced coercivity. Room-temperature coercivities up to 7.0 kOe have been reported for aligned single-crystalline Co nanorods.

What is needed is high coercivity exceeding 10 kOe at room temperature which will serve as ideal building blocks for future bonded, consolidated and thin film magnets with high energy density and high thermal stability.

SUMMARY OF THE INVENTION

The present invention provides high-energy magnets that are alternative to the use of rare earth materials as magnets. A high energy product or magnet of the invention includes at least one magnetic element forming single crystal nanowires that bond to form the high energy product or magnet. A magnetic element may be Fe, Co, Ni, or other magnetic metals. The magnet material may further be an alloy of two of the above materials, for example but not restricted to, Fe and Co wherein the composition of Fe:Co by atomic percent may vary from 40:60 to 70:30.

The magnet material is developed into a high energy product by forming nanowires through a solvothermal chemical method and then forming resin-bonded nanowires. In some cases, more than 60 percent of the nanowires are aligned so that their axes are parallel to each other. The individual nanowires are single crystals that may have a crystal lattice of either body-centered cubic (BCC) structure or hexagonal close packed (HCP). The individual nanowires further have a diameter in the range of 1-200 nm and a length to diameter aspect ratio in the range of 10-50. In some embodiments, the nanowires have an aspect ratio greater than 10 and less than 100. In some instances, the nanowires have an aspect ratio greater than 10 and less than 30. The nanowires, in some cases, have a diameter greater than 1 nm and less than 50 nm. In some instances, the nanowires have a diameter greater than 10 nm and less than 100 nm, For example, a high energy product includes at least one material A selected from the group consisting essentially of Fe, Co, and Ni, wherein the material A is in the form of nanowires formed by a solvothermal chemical process.

In addition, a high energy product includes at least one material A selected from the group consisting essentially of Fe, Co, and Ni, and at least one material B selected from the group consisting essentially of Fe, Co, and Ni, wherein material A and material B are in the form of an alloy of nanowires formed by a solvothermal chemical process.

Moreover, a method for manufacturing a high energy product includes providing nanowires made of at least one material A selected from the group consisting essentially of Fe, Co, and Ni, using a solvothermal chemical process and bonding the nanowires together with a resin. In some examples, the nanowires may further include at least one material B selected from the group consisting essentially of Fe, Co, and Ni such that material A and material B form an alloy.

Details associated with the embodiments described above and others are described below. The present invention is described in detail below with reference to the accompanying drawings.

BRIEF DESCRIPTION OF THE DRAWINGS

The above and further advantages of the invention may be better understood by referring to the following description in conjunction with the accompanying drawings, in which:

FIGS. 3A-3H illustrate magnetic hysteresis and morphology in accordance with an embodiment of the present invention: magnetization loops of an aligned Co nanowire sample in epoxy (along parallel and perpendicular direction) at 300 K (FIG. 3A), magnetization loops of aligned Co nanowires in epoxy (along parallel and perpendicular direction) at 300 K (FIG. 3B), second quadrant B-H curves for the aligned Co nanowires in epoxy (along the easy axis) at 300 K of sample (a) and (b) respectively (FIGS. 3C and 3D), TEM images of the Co nanowires corresponding to samples (a) and (b) respectively (FIGS. 3E and 3F), and the histograms of the Co nanowires showing their length distributions of the samples shown in (e) and (f) respectively obtained using statistical analysis of 600 nanowires each (FIGS. 3G and 3H);

FIGS. 4A-4D illustrate TEM images of FeCo nanocrystals synthesized by varying the molar ratio of surfactant (OA) to metal precursor (Fe+Co) in accordance with an embodiment of the present invention: 2.5:1 (FIG. 4A), 3:1 (FIG. 4B), 3.5:1 (FIG. 4C), and 4:1 (FIG. 4D);

FIGS. 5A-5D illustrate High-resolution TEM (HRTEM) image of a FeCo nanowire (FIG. 5A), magnification of FeCo nanowires in the zone marked in (a) with a dashed square (FIG. 5B), FFT image of the zone marked with a dashed square (FIG. 5C), and energy dispersive x-ray spectroscopy (EDX) spectra of FeCo nanowires (FIG. 5D);

FIGS. 6A-6D illustrate TEM images of FeCo nanocrystals synthesized with varying molar ratio between surfactant (TOP) and metal precursors (Fe+Co) in accordance with on embodiment of the present invention: without addition of TOP (FIG. 6A), 2:1 (FIG. 6B), 4:1 (FIG. 6C), and 8:1 (FIG. 6D);

DETAILED DESCRIPTION OF THE INVENTION

Figure 1A:
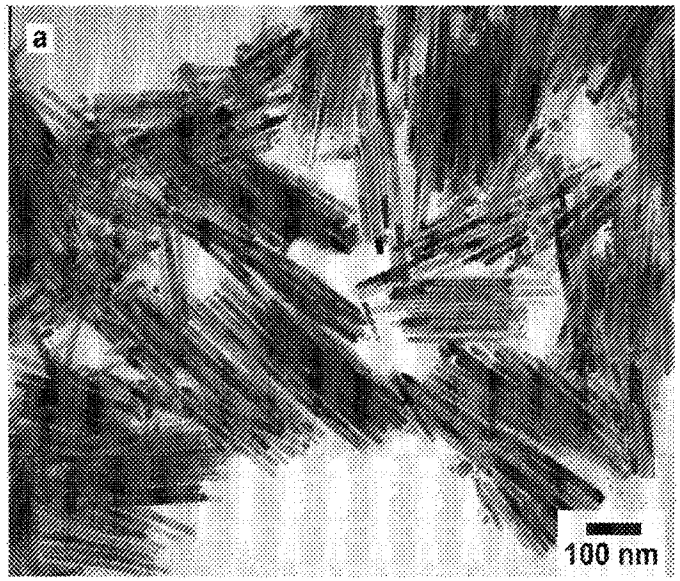
FIGS. 1A-1D illustrate transmission electron microscopy (TEM) analysis of Cobalt nanowires in accordance with an embodiment of the present invention: bright-field TEM image of the Co nanowires (FIG. 1A), bright-field TEM image of an end-tip single Co nanowire (FIG. 1B), high resolution TEM image of a single Co nanowire in [11-20] zone axis with an inset the corresponding numerical fast Fourier transform (FFT) pattern (FIG. 1C), and hologram of a single Co nanowire (FIG. 1D)

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

The high energy products or magnets of the invention comprise nanowires bonded together, wherein the nanowires themselves are crystal structures of the magnet material. The magnet material may be a magnetic material such as Co or a magnetic metallic alloy such as Fe—Co. Example magnet preparation for the above two materials are provided in the examples section below. Other magnetic materials and alloys can be used. Note that use of the term nanowires also includes the term nanorods and other nano structures having the characteristics described below.

The high energy products or magnets of the invention provide a number of advantages over known ferromagnets. For example, but not limited to, the high energy products or magnets of the invention have better magnetization and better retention of magnetic properties over a range of temperatures.

Record high room-temperature coercivity has been developed in nanocrystalline Co metal material with high aspect ratio, synthesized through a carefully controlled chemical solvothermal process, which resulted in high energy product in the material. Shape anisotropy provides the basis of the enhanced coercivity, and the orientation and uniformity of the single-domain nanocrystals are essential for achieving high magnetic energy density. For example and as illustrated below, Co nanowires with diameters of 15 nm and an average length of 200 nm have a record high coercivity of 10.3 kOe at room temperature, leading to an energy product of 44 MGOe.

In another example, single-crystal FeCo nanowires are synthesized using the reductive decomposition of organometallic precursors in the presence of surfactants. Monocrystalline FeCo nanowires exhibit high magnetic coercivity up to 1.2 kOe at room temperature. Study of the effects of the surfactant ratio, Fe to Co precursors ratio and the heating rate on the morphology, structure and magnetic properties of the nanomaterial are described below.

Example 1: Co Nanowire Preparation

A non-limiting example of Co nanowire preparation will now be described in accordance with an embodiment of the present invention.

$CoCl_2.6H_2O$ (Alfa Aesar, 99.9%), $RuCl_3$ (Aldrich, 45-55% Ru content), NaOH (Sigma Aldrich, 97%), 1,2-butanediol (Fluka, 98%), Hexadecylamine (Aldrich, 98%), methanol (VWR, Normapur) and lauric acid ($C_{11}H_{23}COO$) (Aldrich, 98%) may be used without any further purification.

The cobalt (II) laurate, $Co(C_{11}H_{23}COO)_2$ may be prepared following a procedure adapted from a synthesis for the cobalt (II) laurate salt. Lauric acid (44.0 mmol) and NaOH (42.0 mmol) were added to 40 ml DI water while being mixed using a mechanical stirrer. The resulting mixture may be heated to 60° C. until a clear solution is obtained. 10 mL of an aqueous solution of 2 M $CoCl_2.6H_2O$ (99.9%) (20.0 mmol) may then be added drop wise to the solution with vigorous mechanical stirring. Slowly, a purple precipitate is formed, and the mixture is stirred and kept at 60° C. for 30 minutes after the $CoCl_2.6H_2O$ addition. The precipitate is then recovered by centrifugation (6000 rpm for 15 mins per wash), one time with 45 mL DI water and three times with 45 mL of methanol then dried in an air oven at 60° C. followed by drying under vacuum.

Cobalt (II) laurate (2.07 g, 4.5 mmol), $RuCl_3$ (0.0037 g, 0.018 mmol), Hexadecylamine (0.5810 g, 2.4 mmol) and 60 mL of 1,2 Butanediol may be introduced inside a teflon enclosure (100 mL) with the Ru/Co molar ratio fixed at 0.4%. The teflon enclosure is then purged with forming gas (Ar 93% $H_2$ 7%) for 5 mins then sealed. Afterwards, the enclosure was placed in a heated, ultrasonic water bath adjusted to 80° C. The contents within the enclosure are then mixed for 60 mins using the ultrasonic function of the water bath. The temperature of the water bath is maintained at 80° C. throughout the mixing process. Next, the teflon enclosure is removed from the water bath and fitted within an autoclave reactor. The autoclave reactor was transferred to a furnace and heated from room temperature to 250° C. at a rate of 8° C. per minute then maintained at 250° C. for 75 mins. After cooling to room temperature, the black powder consisting of cobalt nanowires is separated from reaction fluid by centrifugation at 6000 rpm for 15 mins. The powder was collected then redispersed in 30 ml toluene using an ultrasonic bath. The sample is centrifuged once again at 6000 rpm for 15 min and the toluene discarded. This purification step is repeated two more times. After the purification, cobalt nanowires may be dried in a vacuum oven at 50° C. then stored within a glove box with Ar atmosphere.

Example Co nanowires developed in the above method were characterized as follows. The transmission electron microscopy (TEM) images were recorded on a JEOL 1200 EX electron microscope at an accelerating voltage of 120 kV. The nanowires samples were prepared evaporating the toluene dispersion on carbon-coated copper grids. High resolution TEM images were obtained with a Hitachi H-9500 high-resolution TEM with an accelerated voltage of 300 kV. Lacey carbon grids were used for high resolution TEM (HRTEM) investigation. Electron holography image of single-cobalt nanowire was recorded digitally at an accelerating voltage of 200 kV in a JEOL JEM-2100F-LM field emission gun TEM equipped with JEOL biprism (0.6 mm diameter, 180 u rotation), in a remanent field about 4 Oe. The reconstructed phase image of specimen provides a visual picture of magnetic flux in form of contours.

Powder X-ray diffraction (XRD) spectra were recorded on a Rigaku Ultima IV diffractometer with a Cu K-a wavelength X-ray source. Magnetic measurements of the metallic samples were performed using a Quantum Design MPMS magnetometer (SQUID). Randomly oriented Co nanowire samples for magnetic characterization were prepared by dispersing then curing in a rapid-set epoxy resin. Aligned Co nanowires were prepared by sonicating the toluene dispersion for 5 min then adding the epoxy into the Co nanowires/toluene dispersion and again sonicating for 2 min. This composite was then poured into a mold and allowed to cure under the external magnetic field of 2.0 T in an electromagnet.

In order to determine the actual magnetization of the as synthesized Co nanowires before hardening into epoxy, inductively coupled plasma mass spectrometry (ICPMS) was used to quantitatively determine the mass of the Co metal in the nanowire samples. The Co nanowires were initially washed 3 times with toluene and dried in glove box to prevent oxidation. The dried samples were weighed in a vial then digested with 1 ml of concentrated $HNO_3$ at room temperature. After 1 hour, the solution was diluted down with 1% $HNO_3$ to the appropriate concentration for the ICP-MS analysis. The results indicate that Co nanowires contain (by weight) 85.4% of Co which was used to calibrate the magnetization values of the nanowires.

Figure 1B:
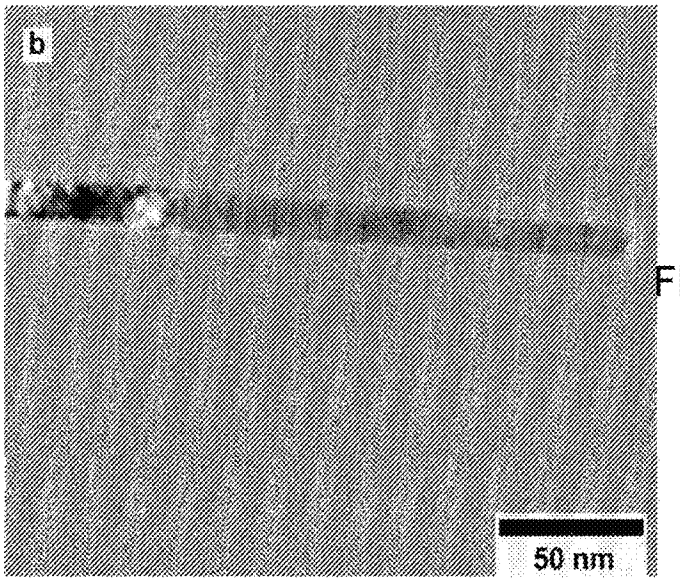
Figure 1C:
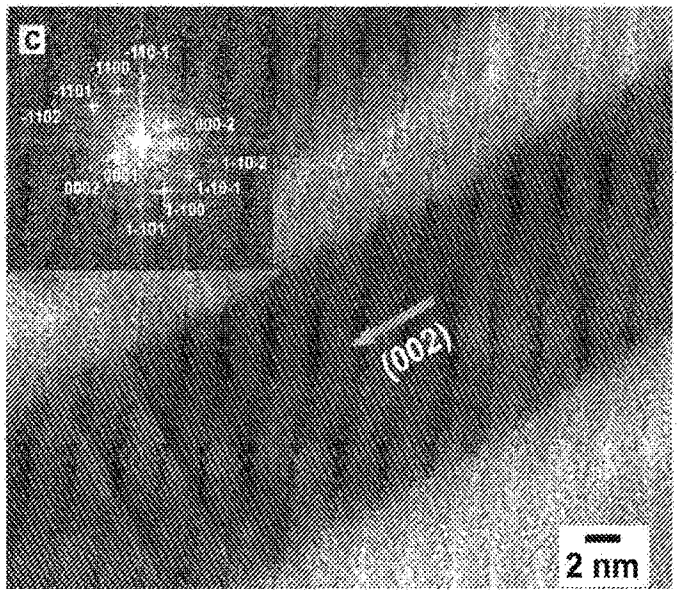
Figure 1D:
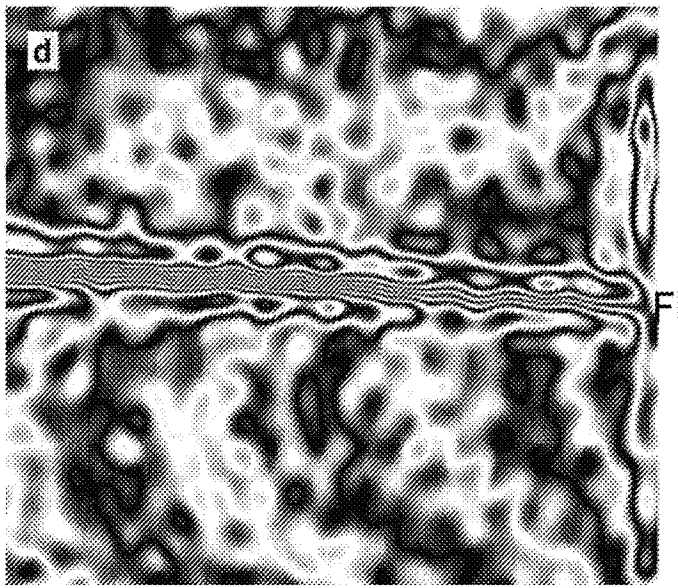

Now referring to FIGS. 1A-1D, the morphology of the example Co nanowires synthesized above via a solvothermal chemical process in accordance with an embodiment of the present invention are shown. X-ray diffraction shows that the wires have an expected HCP crystal structure. As shown in FIGS. 1A and 1B, the Co nanowires have cylinder shapes with ellipsoidal tips. The wires have typical size about 200 to 300 nm in length and an average diameter of 15 nm from the TEM observation. The high-resolution TEM results (FIG. 1C) indicate that each wire is a single crystal with the c-axis (002), or the easy magnetization direction, along the long axis of the wire. The magnetic holography image (FIG. 1D) reveals a single-domain structure and confirms the magnetization orientation along the long axis. This magneto-crystalline configuration, coupled with the shape of high aspect ratio, favors a coherent rotation of the magnetization process and thus leads to higher coercivity of the nanowire assemblies.

In the case of an ellipsoid ferromagnet, if one assumes a coherent rotation of the magnetization, the shape anisotropy field $H_A$ is given by:

$$H_A = J_s(N_a - N_c)$$

where $N_a$ and $N_c$ are the de-magnetizing factors along the short and long axes, respectively. $J_s$ is the magnetic induction and it is 18 kG for Co at room temperature. For infinitely long ellipsoids $N_a = ½$ and $N_c = 0$. If the long-axis direction of a Co nanowire conforms to its magneto-crystalline uniaxial direction [0001] (c-axis, or normal direction of the (002) planes), as observed in FIG. 1C, the maximum magnetic anisotropy field contributed from the shape anisotropy will be 9 kOe. Plus the anisotropy field of 7.6 kOe contributed by the magneto-crystalline anisotropy of bulk cobalt, a total anisotropy field up to 16.6 kOe at room temperature may be reached, which shows the upper limit of coercivity that can be developed from Co nanocrystals with high aspect ratio.

Figure 2A:
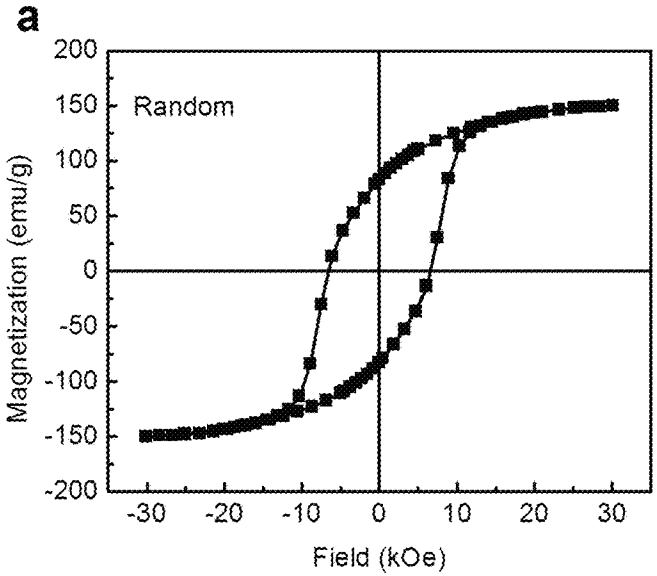
FIGS. 2A-2D illustrate magnetic and structural characterizations in accordance with an embodiment of the present invention: magnetization loop of a randomly oriented Co nanowire assembly at 300 K (FIG. 2A), magnetization loop of the aligned Co nanowire assembly (along parallel direction) at 300 K (FIG. 2B), x-ray diffraction (XRD) pattern of the Co nanowires in random orientation (FIG. 2C), and XRD pattern of aligned Co nanowires in the alignment direction (FIG. 2D)
Figure 2B:
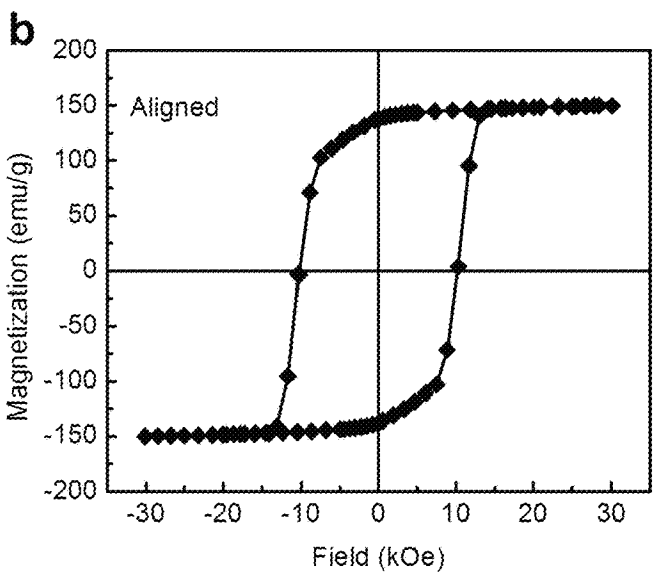
Figure 2C:
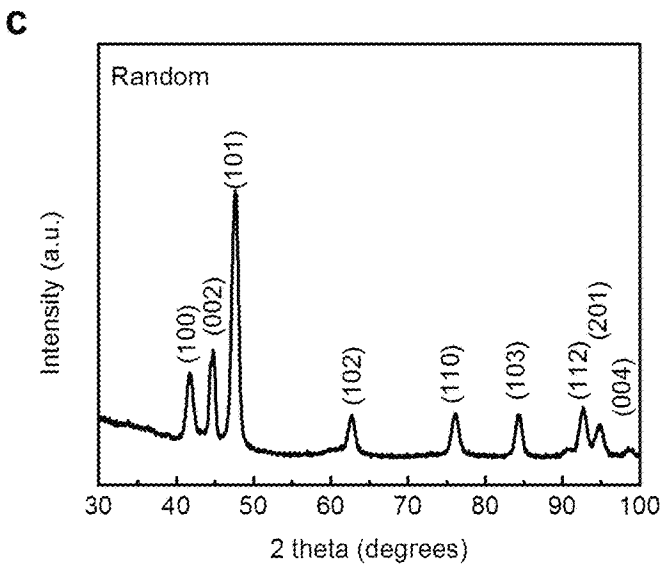
Figure 2D:
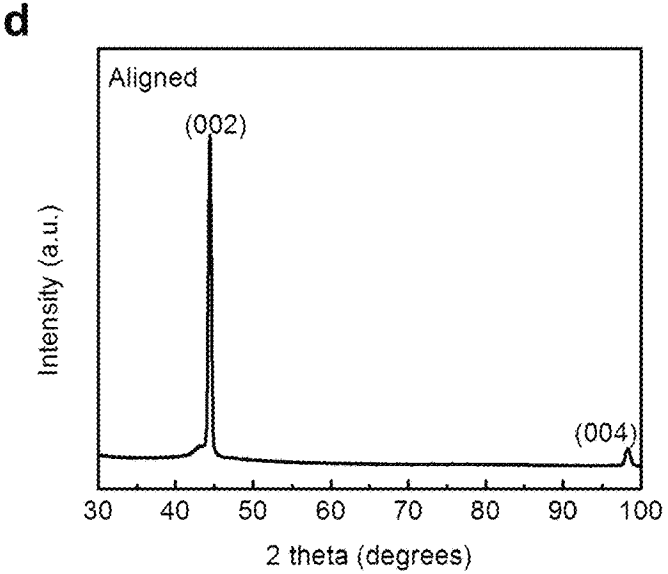

Referring now to FIGS. 2A-2D, magnetic and structural characterizations of Co nanowires are illustrated in accordance with an embodiment of the present invention: magnetization loop of a randomly oriented Co nanowire assembly at 300 K (FIG. 2A), magnetization loop of the aligned Co nanowire assembly (along parallel direction) at 300 K (FIG. 2B), XRD pattern of the Co nanowires in random orientation (FIG. 2C), and XRD pattern of aligned Co nanowires in the alignment direction (FIG. 2D).

FIG. 2A shows the magnetic hysteresis loop at room temperature of a randomly oriented Co nanowire assembly. X-ray diffraction of the assembly is shown beneath in FIG. 2C. Significant coercivity exceeding 6.5 kOe is observed, attributed to the magneto-crystalline anisotropy and the shape anisotropy. Although bulk Co material has an anisotropy field of 7.6 kOe, it is practically difficult to obtain a coercivity value of 6.5 kOe for any bulk cobalt materials. Shape anisotropy has played a substantial role in magnetic hardening of the nanowire assembly.

Another character of the magnetization loop shown in FIG. 2A is the remanent magnetization ratio, $M_r/M_s$ (ratio of the remanent magnetization over the saturation magnetization). In a randomly oriented single-domain particle system, the $M_r/M_s$ ratio is 0.5, which is exactly the situation observed in FIG. 2A. A corresponding parameter that also reflects the degree of the orientation (alignment) of the domains is the 'squareness' of the loop in the second quadrant, measured by the ratio of the area covered by the loop curve (demagnetization curve) and the area of the rectangular $M_rH_c$. As expected, the loop of the randomly oriented system has a modest squareness (0.60).

A dramatic change was observed in the hysteresis loop when the nanowires were aligned in a magnetic field (FIG. 2B). FIG. 2D is the XRD pattern of the aligned wires along the magnetic field direction. One can see clearly from the XRD pattern that all the wires were aligned with their c-axis parallel to the magnetic field direction, while other diffraction peaks all disappear. As shown in FIG. 2B, the room-temperature coercivity of the magnetically aligned sample has increased to about 10.3 kOe, a record high coercivity value for cobalt material at room temperature, which is nearly double that of the randomly oriented sample (FIG. 2A). The remanent magnetization of the aligned sample also increased greatly, leading to the remanent magnetization ratio $M_r/M_s$ of 0.92, which is an almost doubled value compared to the randomly aligned system (while the saturation magnetization remains unchanged). Consequently, the squareness of the loop is significantly increased (to 0.78). This change is a typical behavior of a single-domain particle system upon magnetic alignment. Based on the model, for an ideal single-domain particle system with identical magnetic properties of the particles, the magnetically aligned assemblies will gain coercivity and remanence values twice that of the corresponding systems that are randomly oriented. This sharp behavior has been rarely observed in actual hard magnetic materials for the reason that identical single-domain particles are difficult to prepare experimentally. The present results also support the statement that total anisotropy field of the nanowire system is the sum of magnetocrystalline anisotropy field and shape anisotropy field (16.6 kOe in total, at room temperature).

From an application point of view, the Co nanowire system of the invention may be even more intriguing as a potential rare-earth-free high-temperature permanent magnet based on its extremely high Curie temperature and the stability of the Co nanorod morphology up to elevated temperatures. In FIG. 3 the energy product of the aligned nanowires in epoxy is estimated based on a 100 percent volume fraction of closely packed Co nanowires using the theoretical density of 8.92 g/cm$^3$ containing closely packed nanowires and have obtained a $(BH)_{max}$ value up to 44 MGOe. Although this result does not reflect any effects that can potentially reduce the energy density of a bulk magnet such as packing factor, demagnetization or dipolar interactions, the Co nanowires of the invention can be ideal building blocks for high performance bonded magnets, consolidated magnets, as well as thin film magnets with both isotropic and anisotropic magnetic structures.

To further understand the effect of morphology on the coercivity and magnetization hysteresis in the nanowire systems, two groups of samples were compared; one with more uniform morphology and the other with less uniform morphology. FIGS. 3A-3H show the details of the two representative samples in magnetization and morphology. Histogram analysis (FIGS. 3G and 3H) shows that the major difference in morphology of the two groups of nanowires is the length distribution. The first group has the length range from 10 nm to 600 nm and the second group from 100 nm to 400 nm. Magnetization measurements did not show a noticeable difference in coercivity (both are above 10 kOe). However one can find an obvious difference in the squareness (0.66 and 0.78 respectively, as shown in FIGS. 3C and 3D). This difference has not been trivial in view of the energy product. In fact, the squareness of the demagnetization curves has the same important effect as the remanent magnetization and coercivity on the energy product (shown as the shadowed squares in FIGS. 3C and 3D). It is striking to see that the small difference in the squareness has led to about a 25% difference in energy product of the two groups of samples. It is understood that in nanostructured ferromagnet systems, morphology uniformity plays an important role in magnetic reversal process. A narrowly distributed shape and nanowire length with diameters of appropriate dimension can lead to a coherent magnetization reversal process that gives rise to enhanced coercivity and squareness of the loops.

Example 2: Fe—Co Nanowire Preparation

A non-limiting example of Fe—Co nanowire preparation will now be described in accordance with an embodiment of the present invention.

0.75 mmol of iron (III) acetylacetonate ($Fe(acac)_3$), 0.5 mmol of cobalt acetylacetonate ($Co(acac)_2$) and 1.5 mmol 1,2-hexadecanediol were added to a 125 mL flask with a magnetic stir bar and mixed with 4.37 mmol (1.4 ml) of oleic acid (OA). After purging 20 min at room temperature using forming gas (Ar 93%+$H_2$ 7%), 5 mmol (2.28 ml) of trioctylphosphine (TOP) was injected into the reaction mixture, after which the temperature was raised to 100° C. and kept constant for 10 min. Afterwards, the flask was heated to 200° C. at 10° C. per min and the temperature was held for 30 min. Then the flask was heated to 300° C., where it was held for 90 min. The heating rate was varied from 2 to 15° C. per min when the reaction was heated from 200 to 300° C. The reactor was purged with forming gas throughout all reactions. Thereafter, the product was handled in air. The product was collected from the surface of a magnetic stir bar and dispersed in hexane (10 ml) and precipitated using absolute ethanol (40 ml). That product was washed three times using a mixture of hexane and absolute ethanol (10 ml hexane and 40 ml ethanol) and finally dispersed in hexane. $Fe_{60}Ca_{40}$ nanocrystals are obtained by adjusting the initial molar ratio of $Fe(acac)_3$ and $Co(acac)_2$ precursors.

TEM images were recorded on a JEOL 1200 EX electron microscope at an accelerating voltage of 120 kV. Composition analysis was performed using energy dispersive x-ray spectroscopy (EDX). HRTEM images were obtained with a Hitachi H-9500 TEM with an accelerating voltage of 300 kV. Powder XRD spectra were recorded on a Rigaku Ultima IV diffractometer with a Cu Kα x-ray source. The magnetic hysteresis measurements were carried out using an alternating gradient magnetometer with maximum magnetic field of 14 kOe. Samples for magnetic characterization were prepared by depositing a drop of the $Fe_{60}Ca_{40}$ nanowire hexane dispersion on a silicon substrate, evaporating the solvent at room temperature and hardening the randomly oriented FeCo powders in epoxy.

FeCo nanowires with different sizes and shapes were synthesized via modified reductive decomposition in a mixture of two surfactants. Various combinations of OA and TOP surfactants were studied at fixed precursor concentration and fixed reaction temperature. Specific surfactants have preferential adsorption on different crystal facets, which allows growth along one facet while inhibiting growth along other facets. We studied the effect of change in surfactant/precursor concentration ratio in order to observe size and shape control of the nanowires.

The TEM images in FIGS. 4A-4D show that varying the molar ratio of surfactant OA to Fe and Co metal precursor can control the size and shape of nanowires. During chemical synthesis, amount of metal precursors $Fe(acac)_3$ (0.75 mmol), $Co(acac)_2$ (0.5 mmol) and surfactant TOP (5.0 mmol) were held constant. The heating rate during reaction was maintained at 10° C. min$^{-1}$. FeCo nanoparticles with diameters of 12-25 nm were formed when the molar ratio of OA to Fe+Co metal precursor was 2.5:1 (FIG. 4A). By increasing the molar ratio to 3.0:1 (FIG. 4B), a mixture of particles with diameters of 6-25 nm and nanowires of length 40-60 nm and diameters of 2-3 nm were obtained. A further increase in molar ratio to 3.5:1 (FIG. 4C) led to formation of nanowires of lengths of 60-140 nm and diameters of 4-8 nm. The products became a mixture of nanorods and nanoparticles when molar ratio was increased to 4.0:1 (FIG. 4D).

Now referring to FIG. 5A, a HRTEM image of a monocrystalline FeCo nanowire is shown. The inter-planar spacing of the nanowire is 0.20 nm, which corresponds to FeCo (110) oriented along the wire axis (FIG. 5B). The fast Fourier transform (FFT) from the image shown in FIG. 5A also exhibits the FeCo (110) lattice spacing (FIG. 5C). Elemental compositions of the nanowires were analyzed using EDX. The EDX spectra (FIG. 5D) of samples give atomic composition ranges of the nanowires of Fe from 57-63 at % and Co 43-37 at % when 1.5:1 molar ratios of Fe to Co precursors was used. The presence of phosphorus, carbon and oxygen were due to the reaction conditions used for the synthesis of the FeCo nanowires. The excess carbon and Cu were from the TEM grid.

Referring now to FIGS. 6A-6D, the TEM images of FeCo nanocrystals after varying the molar ratio of TOP to the Fe and Co metal precursors are shown. During chemical synthesis, amount of metal pre-cursors $Fe(acac)_3$ (0.75 mmol), $Co(acac)_2$ (0.5 mmol) and surfactant OA (4.37 mmol) were held constant. The heating rate during the reaction was maintained at 10° C. $min^{-1}$. As seen in FIG. 6A, without TOP, only spherical particles with diameters of 10-25 nm were obtained. By introducing TOP into the reaction using the (TOP/(Fe+Co)) molar ratio of 2:1, the average particle size increased (FIG. 6B). Nanowires were obtained when (TOP/(Fe+Co)) molar ratios of 4:1 and 8:1 were used in the reaction (FIGS. 6C and 6D).

The possible formation mechanism of the FeCo nanowires can be illustrated. In the early stage of the synthesis, a common mild reducing agent (1,2-hexadecanediol) was used to enable co-reduction of Fe and Co ions to the corresponding reduced atomic state at an elevated temperature. The rapidly produced Fe and Co atoms reached a supersaturation level initiating a burst nucleation, depending on the level of supersaturation, which controlled the initial number of nuclei containing Fe—Co atoms. This mechanism suggests a burst nucleation followed by a diffusional growth, leading to monodisperse nanoparticles, due to the temporally discrete nucleation. The remaining solvated Fe and Co atoms along with the surfactant-complexed atomic species interact with the nuclei through diffusional growth until the atoms are depleted from the fluid medium. The preferred growth direction of the nanoparticles when nanowires or rods are formed can be induced through control of the type of surfactant and the surfactant concentration. Usually, a multi-surfactant system favors the formation of an anisotropic nanostructure. In this case, the employed TOP and OA both can act as surfactants to cover different crystallographic surfaces of newly formed nanocrystal seeds, and eventually lead to the anisotropic growth toward the (110) axis, forming a one-dimensional nanostructure. The shape of the nuclei can have a strong effect on the shape of the final nanocrystals, for example, through selected growth of high-energy crystal faces of the nuclei. However, the metallic nanowire and nanorod structures are not thermodynamically favorable and commonly transition to a spherical shape if the reaction is not quenched at the proper time and temperature. It has also been reported that nuclei may initially follow diffusional growth to form primary small particles, which then aggregate into the final particles; this process is called the 'aggregation of subunits' mechanism. Further, if nucleation is not a one-time event or if nuclei cannot grow at the same time, an Ostwald ripening process will occur. This diffusion limited to the ripening process. During this process, the smaller particles dissolve (due to their high surface energy), feeding the growth of larger particles.

Figure 7B:
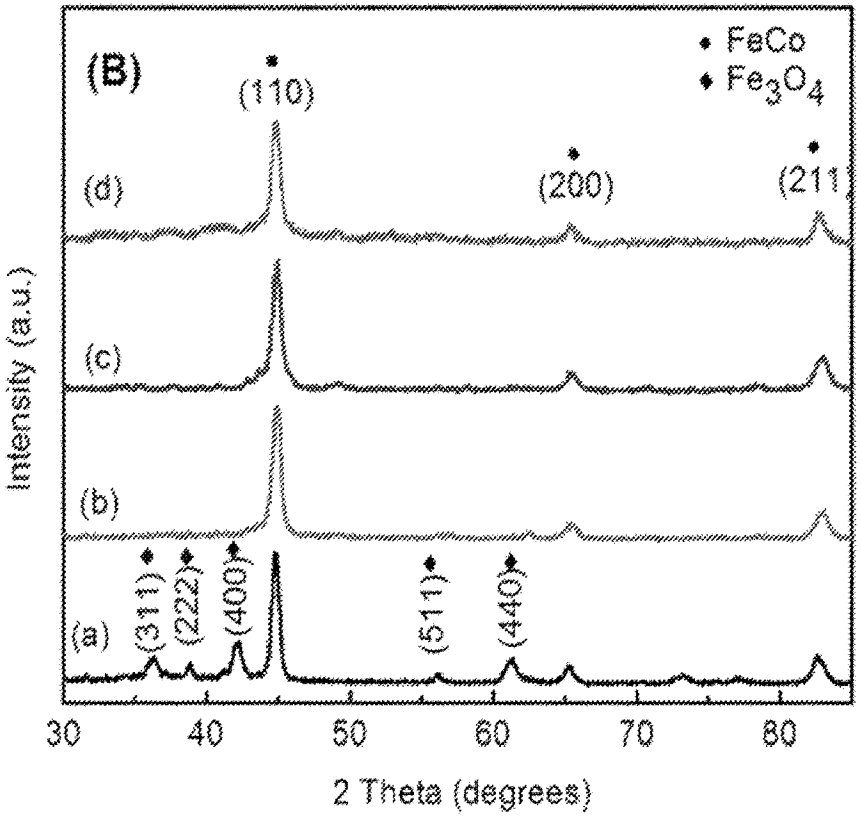
FIGS. 7A-7B illustrate XRD of FeCo nanocrystals with BCC structure synthesized with varying molar ratio between surfactant (OA) and metal precursors (Fe+Co) in accordance with an embodiment of the present invention: (a) 2.5:1, (b) 3:1, (c) 3.5:1 and (d) 4:1 (FIG. 7A), and XRD patterns of FeCo nanocrystals synthesized with varying molar ratio between surfactant (TOP) and metal precursors (Fe+Co): (a) without addition of TOP, (b) 2:1, (c) 4:1, and (d) 8:1 (FIG. 7B)
Figure 7A:
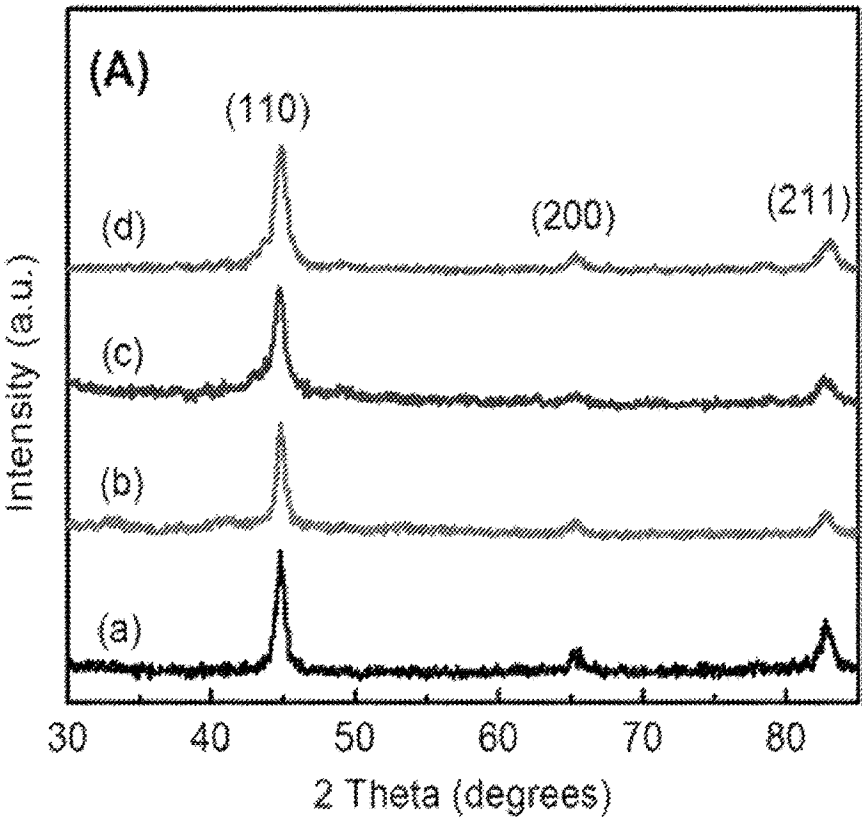

Now referring to FIG. 7A, the XRD patterns of the FeCo nanocrystals are shown prepared by varying the molar ratio of surfactant OA to Fe and Co metal precursors (a) 2.5:1, (b) 3:1, (c) 3.5:1 and (d) 4:1, which show the diffraction peaks of FeCo phase with BCC crystal structure. The strongest reflection for FeCo alloy corresponded to the (110) lattice plane. FIG. 7B shows the XRD patterns of the FeCo nanoparticles and nanowires prepared by varying the TOP concentration, which show that the synthesized FeCo nanocrystals have a BCC structure. It was observed that the presence of a $Fe_3O_4$ phase in the XRD pattern along with FeCo when no TOP was added into the reaction (FIG. 7B (a)). For molar ratios of (TOP/(Fe+Co)) higher than 2:1, the $Fe_3O_4$ phase was not detected by XRD. Since TOP is very reactive with oxygen, it can consume the oxygen molecules in the solution to prevent the oxidation of the metal atoms.

Figure 8B:
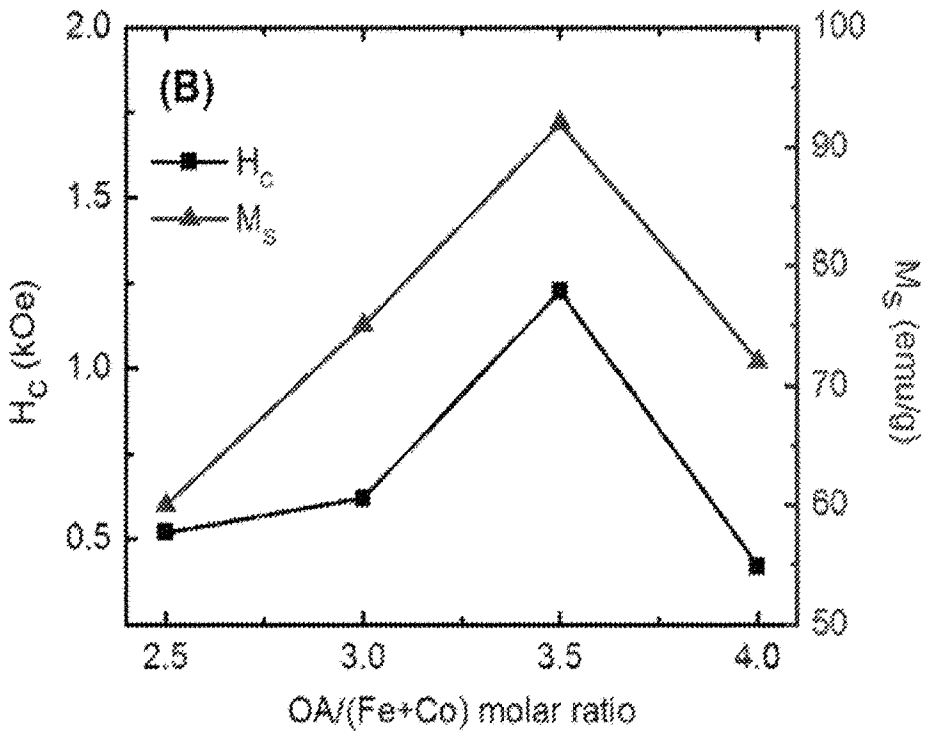
FIGS. 8A and 8B illustrate hysteresis loops of FeCo nanowires synthesized with varying molar ratio between surfactant (OA) and metal precursors (Fe+Co): (a) 2.5:1 and (b) 3.5:1 (FIG. 8A), and change of coercivity and saturation magnetization with varying molar ratio of OA to (Fe+Co) (FIG. 8B).
Figure 8A:
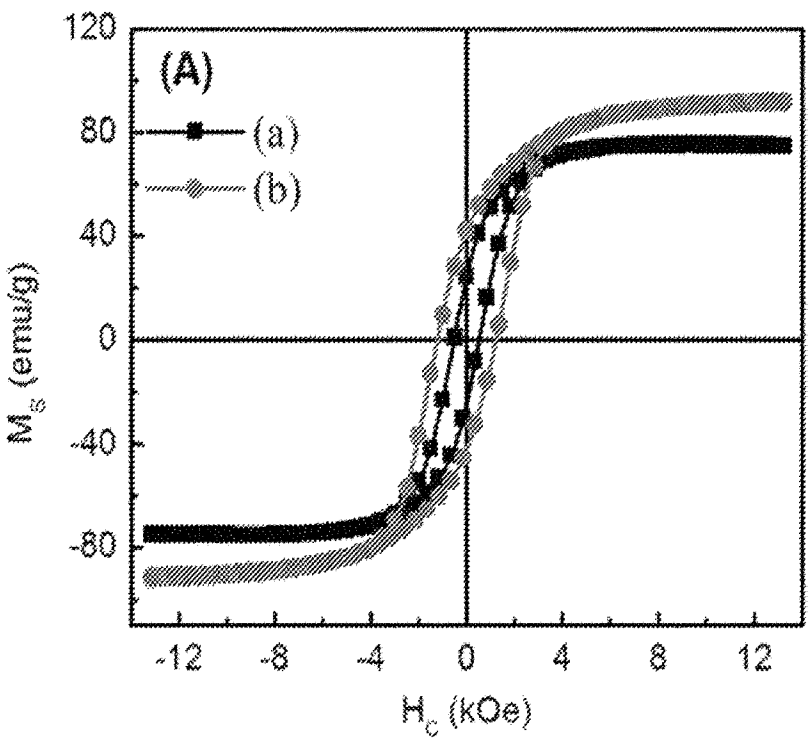

Referring now to FIG. 8A, hysteresis loops of randomly oriented as-prepared FeCo nanocrystals synthesized with varying molar ratio between surfactant (OA) and metal precursors (Fe+Co): (a) 2.5:1 and (b) 3.5:1 are shown. All of the as-prepared FeCo nanocrystals are ferromagnetic at room temperature. It was found that magnetic properties including coercivity and saturation magnetization strongly depend on the morphology of the FeCo nanocrystals. By increasing the molar ratio (OA/(Fe+Co)) from 2.5 to 3.5, both the coercivity and saturation magnetization increased and then decreased with a further increase in the molar ratio to 4.0:1 (corresponding to 1.6 ml), as shown in FIG. 8B. FIGS. 4A-4D show that OA concentration is vital in controlling the morphology, including the aspect ratio of FeCo nanocrystals, which in turn is related to magnetic properties of the nanocrystals. The highest coercive force of 1.2 kOe and a saturation magnetization of 92 emu/g were obtained when the molar ratio of OA to (Fe+Co) was 3.5:1. This led to formation of nanowires with the highest aspect ratio (~35) as seen in FIG. 4C. A ratio of remanence to saturation magnetization ($M_r/M_s$) of ~0.5 was obtained for the FeCo nanowire assembly of randomly oriented nanowires. The presence of surfactants on the surface of nanocrystals causes difficulty in determining actual magnetization value. It is difficult to completely remove the surfactant (mainly TOP) from the surfaces of the nanocrystals. The relatively low saturation magnetization could be attributed to a thick layer of surfactant on the surface and a surface spin-canting effect. On the other hand, the saturation magnetization values obtained in our measurements for each sample are independent of the sample morphology and orientation, because the field we used (>12 kOe) has overcome the anisotropy fields and reached the saturation.

The terms "a" and "an" are defined as one or more unless this disclosure explicitly requires otherwise. The term "substantially" is defined as largely but not necessarily wholly what is specified (and includes what is specified; e.g., substantially 90 degrees includes 90 degrees and substantially parallel includes parallel), as understood by a person of ordinary skill in the art. In any disclosed embodiment, the terms "substantially," "approximately," and "about" may be substituted with "within [a percentage] of" what is specified, where the percentage includes 0.1, 1, 5, and 10 percent.

The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, an apparatus that "comprises," "has," "includes" or "contains" one or more elements possesses those one or more elements, but is not limited to possessing only those elements. Likewise, a method that "comprises," "has," "includes" or "contains" one or more steps possesses those one or more steps, but is not limited to possessing only those one or more steps.

Any embodiment of any of the apparatuses, systems, and methods can consist of or consist essentially of—rather than comprise/include/contain/have—any of the described steps, elements, and/or features. Thus, in any of the claims, the term "consisting of" or "consisting essentially of" can be substituted for any of the open-ended linking verbs recited above, in order to change the scope of a given claim from what it would otherwise be using the open-ended linking verb.

The feature or features of one embodiment may be applied to other embodiments, even though not described or illustrated, unless expressly prohibited by this disclosure or the nature of the embodiments.

Although preferred embodiments of the present invention have been described in detail, it will be understood by those skilled in the art that various modifications can be made therein without departing from the spirit and scope of the invention as set forth in the appended claims.

REFERENCES

The following references, to the extent that they provide exemplary procedural or other details supplementary to those set forth above, are specifically incorporated by reference.

[1] Cowburn R P and Welland M E, Room temperature magnetic quantum cellulare automata, *Science* 287, 1466-1468 (2000).

[2] Elias A L et al., Production and Characterization of Single-Crystal FeCo Nanowires Inside Carbon Nanotubes, *Nano Lett.* 5, 467-472 (2005).

[3] Sudfeld D et al., Microstructural investigation of ternary alloyed magnetic nanoparticles, *J. Magn. Magn. Mater.* 293, 151-161 (2005).

[4] Xu Y H, Bai J and Wang J P, High-magnetic-moment multifunctional nanoparticles for nanomedicine applications, *J. Magn. Magn. Mater.* 311, 131-134 (2007).

[5] McHenry M E, Willard M A and Laughlin D E, Amorphous and Nanocrystalline Materials for Applications as Soft Magnets, *Prog. Mater. Sci.* 44 291 (1999).

[6] Lin W S, Lin H M, Chen H H, Hwu Y K and Chiou Y J, Shape of Iron Nanowires on Hyperthermia Treatment, *J. Nanomater.* 237439 (2013).

[7] Gandha K, Elkins K, Poudyal N, Liu X and Liu J P, High energy product developed from cobalt nanowires, *Sci. Rep.* 4:5345 (2014).

[8] Atmane K A et al., High temperature structural and magnetic properties of cobalt nanorods, *J. Solid State Chem.* 197, 297-303 (2013).

[9] Soumare Y, Dakhlaoui-Omrani A, Schoenstein F, Mercone S, Viau G and Jouini N, Nickel nanofibers and nanowires: Elaboration by reduction in polyol medium assisted by external magnetic field, *Solid State Commun.* 151 284-288 (2011).

[10] Gandha K, Poudyal N, Zhang Q and Liu J P, Effect of $RuCl_3$ on Morphology and Magnetic Properties of CoNi Nanowires, *IEEE Trans. Magn.* 49, 3273-3276 (2013).

[11] Cao Y, Gang A S, Zhang J, Gu N and Hu S, Adv. Mater. Lett. 4 160 (2013).

[12] Luo X J, Xia W B, Gao J L, Zhang S Y, Li Y L, Tang S L and Du Y W, J., Appl. Phys. 113 17B908 (2013).

[13] Li L, J. Appl. Phys. 79 4578 (1996).

[14] Menon L, Bandyopadhyay S, Liu Y, Zeng H and Sellmyer D J, J. Nanosci. Nanotech. 1 149 (2001).

[15] Fodor P S, Tsoi G M and Wenger L E, J. Appl. Phys. 91 8186 (2002).

[16] Tang S L, Chen W, Lu M, Yang S G, Zhang F M and Du Y W, Chem. Phys. Lett. 384 1 (2004).

[17] Alikhanzadeh Arani S, Almasi Kashi M and Ramazani A, J. Curr. Appl. Phys. 13 664 (2013).

[18] Yue G H, Wang L S, Wang X, Chen Y Z and Peng D L, J. Appl. Phys. 105 074312 (2009).

[19] Qin D H, Peng Y, Cao L and Li H L, Chem. Phys. Lett. 374 661 (2003).

[20] Lee G H, Huh S H, Jeong J W, Kim S H, Choi B J, Ri H C, Kim B and Park J H, J. Appl. Phys. 94 4179 (2003).

[21] Wen M, Meng X, Sun B, Wu Q and Chai X, Inorg. Chem. 50 9393 (2011).

[22] Thongmee S, Pang H L, Ding J and Lin J Y, J. Magn. Magn. Mater. 321 2712 (2009).

[23] Chaubey G S, Barcena C, Poudyal N, Rong C B, Gao J, Sun S and Liu J P, J. Am. Chem. Soc. 129 7214 (2007).

[24] Nair P S, Fritz K P and Scholes G D, Small 3 481 (2007).

[25] Bao Y, An W, Turner C H and Krishnan K M, Langmuir 26 478 (2010).

[26] Puntes V F, Krishnan K M and Alivisatos P A, Science 291 2115 (2001).

[27] LaMer V K and Dinegar R H, J. Am. Chem. Soc. 72 4847 (1950).

[28] Warner J H and Cao H, Nanotechnology 19 305605 (2008).

[29] Xia Y, Xiong Y, Lim B and Skrabalak S E, Angew. Chem., Int. Ed. Engl. 48 60 (2009).

[30] Privman V, Goia D V, Park J and Matijevic E, J. Colloid Interface Sci. 213 36 (1999).

[31] Lifshitz I M and Slyozov V V, J. Phys. Chem. Solids 19 35 (1961).

[32] Morales M P, Veintemillas-Verdaguer S, Montero M I, Serna C J, Roig A, Casas L I, Martinez B and Sandiumenge F, Chem. Mater. 11 3058 (1999).

[33] Azizi A, Sadrnezhaad S K and Hasani A, J. Magn. Magn. Mater. 322 3551 (2010).

1. Buschow, K., Intermetallic compounds of rare-earth and 3d transition metals. Reports on Progress in Physics, *Rep. Prog. Phys.* 40, 1179-1256 (1977).

2. Gutfleisch, O. et al., Magnetic materials and devices for the 21st century: stronger, lighter, and more energy efficient, *Adv. Mater.* 23, 821-42 (2011).

3. Burkert, T., Nordstrom, L., Eriksson, O. & Heinonen, O., Giant Magnetic Anisotropy in Tetragonal FeCo Alloys, *Phys. Rev. Lett.* 93, 027203 (2004).

4. Oliver, D. A. & Shedden, J. W., Cooling of permanant-magnetic alloy in a constant magnetic field, *Nature* 3587, 209 (1938).

5. Sun, L., Hao, Y., Chien, C.-L. & Searson, P. C., Tuning the properties of magnetic nanowires, *IBM J. RES. & DEV.* 49, 79-102 (2005).

6. Poudyal, N. et al., Synthesis of FePt nanorods and nanowires by a facile method, *Nanotechnology* 19, 355601 (2008).
7. Hao, R. et al., Synthesis, Functionalization, and Biomedical Applications of Multifunctional Magnetic Nanoparticles, *Adv. Mater.* 22, 2729-2742 (2010).
8. Zhang, Y. et al. Controlled synthesis and magnetic properties of hard magnetic CoxC (×5 2, 3) nanocrystals, *J. Magn. Magn. Mater.* 323, 1495-1500 (2011).
9. Gandha, K., Poudyal, N., Zhang, Q. & Liu, J. P. Effect of RuCl3 on Morphology and Magnetic Properties of CoNi Nanowires, *IEEE Trans. Magn.* 49, 3273-3276 (2013).
10. Sellmyer, D. J., Zheng, M. & Skomski, R. Magnetism of Fe, Co and Ni nanowires in self-assembled arrays, *J. Phys. Condens. Matter* 13, R433-R460 (2001).
11. Su, H. L. et al. Geometry dependence of the annealing effect on the magnetic properties of $Fe_{48}Co_{52}$ nanowire arrays, *Nanotechnology* 16, 429-432 (2005).
12. Cattaneo, L. et al. Electrodeposition of hexagonal Co nanowires with large magnetocrystalline anisotropy, *Electrochim. Acta* 85, 57-65 (2012).
13. Maurer, T. et al., Magnetic nanowires as permanent magnet materials, *Appl. Phys. Lett.* 91, 172501 (2007).
14. Dumestre, F. et al. Shape control of thermodynamically stable cobalt nanorods through organometallic chemistry, *Angew. Chem. Int. Ed.* 41, 4286-9 (2002).
15. Soumare, Y. et al. Kinetically Controlled Synthesis of Hexagonally Close-Packed Cobalt Nanorods with High Magnetic Coercivity, *Adv. Funct. Mater.* 19, 1971-1977 (2009).
16. Soulantica, K. et al. Magnetism of single-crystalline Co nanorods, *Appl. Phys. Lett.* 95, 152504 (2009).
17. Fang, W. et al. Optimization of the magnetic properties of aligned Co nanowires/polymer composites for the fabrication of permanent magnets, *J. Nanopart. Res.* 16, 2265 (2014).
18. Cullity, B. D. & Graham, C. D., *Introduction to Magnetic Materials* 2nd edition (John Wiley & Sons, Inc., 2009).
19. Skomski, R. & Coey, J. M. D., *Permanent Magnetism* (Taylor & Francis Group, 1999).
20. Stoner, E. C. & Wohlfarth, E. P. A mechanism of magnetic hysteresis in heterogeneous alloys, *Philos. Trans. R. Soc. London* A240, 599-642 (1948).
21. Ait-Atmane, K. et al. High temperature structural and magnetic properties of cobalt nanorods, J. *Solid State Chem.* 197, 297-303 (2013).
22. Panagiotopoulos, I. et al. Packing fraction dependence of the coercivity and the energy product in nanowire based permanent magnets, *J. Appl. Phys.* 114, 143902 (2013).
23. Skomski, R., Liu, Y., Shield, J. E., Hadjipanayis, G. C. & Sellmyer, D. J. Permanent magnetism of dense-packed nanostrucutres, *J. Appl. Phys.* 107, 09A739 (2010).
24. Kulkarni, S., Alurkar, M. & Kumar, A., Polymer support with Schiff base functional group with cobaltous palmitate as oxidation catalyst for cyclohexane, *Appl. Catal. A* 142, 243 (1996).

What is claimed is:

1. A method for manufacturing a high energy product, the method comprising:

forming nanowires using a solvothermal chemical process; and aligning the nanowires in a resin, wherein the nanowires are made of at least one material A selected from the group consisting of Fe, Co, and Ni, and wherein the nanowires are not made only of Fe.

2. The method of claim 1, wherein the nanowires have a crystal lattice structure selected from the group consisting of a body-centered cubic (BCC) structure, and a hexagonal close packed (HCP) structure.

3. The method of claim 1, wherein the nanowires have a diameter in the range of 1-200 nm.

4. The method of claim 1, wherein the nanowires have an aspect ratio greater than 10 and less than 100.

5. The method of claim 1, wherein more than 60 percent of the nanowires are aligned so that their axes are parallel to each other.

6. The method of claim 1, wherein the material A comprises Co.

7. The method of claim 6, wherein the nanowires have a crystal lattice structure selected from the group consisting of a BCC structure, and a HCP structure.

8. The method of claim 6, wherein the nanowires have a diameter greater than 1 nm and less than 50 nm.

9. The method of claim 6, wherein the nanowires have an aspect ratio greater than 10 and less than 30.

10. The method of claim 1, wherein the nanowires further comprise at least one material B selected from the group consisting of Fe, Co, and Ni, such that the material A and the material B form an alloy.

11. The method of claim 10, wherein the nanowires are made from an alloy of Fe and Co.

12. The method of claim 11, wherein the alloy atomic composition (Fe:Co) is in the range of 40:60 to 70:30.

13. The method of claim 11, wherein the nanowires have a crystal lattice structure selected from the group consisting of a BCC structure, and a HCP structure.

14. The method of claim 11, wherein the nanowires have a diameter greater than 10 nm and less than 100 nm.

15. The method of claim 11, wherein the nanowires have an aspect ratio greater than 10 and less than 100.

* * * * *